US007207650B2

(12) United States Patent
Ikemoto et al.

(10) Patent No.: US 7,207,650 B2
(45) Date of Patent: Apr. 24, 2007

(54) APPARATUS AND METHOD FOR DISCHARGING LIQUID

(75) Inventors: Yuichiro Ikemoto, Kanagawa (JP); Atsushi Nakamura, Kanagawa (JP); Shinichi Horii, Kanagawa (JP)

(73) Assignee: Sony Corporation, Tokyo (JP)

( * ) Notice: Subject to any disclaimer, the term of this patent is extended or adjusted under 35 U.S.C. 154(b) by 0 days.

(21) Appl. No.: 10/480,901

(22) PCT Filed: Jun. 14, 2002

(86) PCT No.: PCT/JP02/05976

§ 371 (c)(1),
(2), (4) Date: Dec. 15, 2003

(87) PCT Pub. No.: WO03/000498

PCT Pub. Date: Jan. 3, 2003

(65) Prior Publication Data

US 2004/0165026 A1 Aug. 26, 2004

(30) Foreign Application Priority Data

Jun. 20, 2001 (JP) ..... 2001-187203

(51) Int. Cl.
*B41J 2/155* (2006.01)

(52) U.S. Cl. ..... 347/42; 347/9

(58) Field of Classification Search ..... 347/40–43
See application file for complete search history.

(56) References Cited

U.S. PATENT DOCUMENTS 5,160,945 A * 11/1992 Drake ..... 347/42
5,257,043 A * 10/1993 Kneezel ..... 347/42
5,600,354 A 2/1997 Hackleman et al.
6,217,148 B1 * 4/2001 Adler et al. ..... 347/41
6,312,097 B1 * 11/2001 Brugman ..... 347/40
6,315,390 B1 * 11/2001 Fujii et al. ..... 347/42

FOREIGN PATENT DOCUMENTS

| | | |
|---|---|---|
| EP | 0 034 060 | 8/1981 |
| EP | 0 512 799 | 11/1992 |
| EP | 0 914 950 | 5/1999 |
| EP | 1 043 159 | 10/2000 |
| JP | 08-267831 | 10/1996 |
| JP | 11-314369 | 11/1999 |
| JP | 2001-1510 | 1/2001 |

OTHER PUBLICATIONS

Office Action for JP 2003-506717 issued Jul. 28, 2006.

* cited by examiner

*Primary Examiner*—Thinh Nguyen
(74) *Attorney, Agent, or Firm*—Sonnenschein Nath & Rosenthal LLP

(57) ABSTRACT

The present invention provides an apparatus for discharging liquid in which nozzles (31) allocated to head chips (25) are so arranged as to overlap at parts of adjacent head chips (25), and the distance $L_s$ between nozzles of adjacent head chips of the same color is set to be even number pitches, while the distance $L_d$ between nozzles of head chips of different color is set to be even number pitches. Thus, tiling part can be printed in the hound's tooth manner in driving line heads employing tiling which has overlapped parts formed therein under time division drive. The problem that coloring of superposed colors at overlapped parts becomes different from that at non-overlapped parts can be prevented.

9 Claims, 12 Drawing Sheets

APPARATUS AND METHOD FOR DISCHARGING LIQUID

BACKGROUND OF THE INVENTION

The present invention relates to an apparatus for discharging liquid which is provided with a head having a plurality of liquid discharge parts having nozzles collaterally arranged therein, and to a method for discharging liquid employing the apparatus for discharging liquid which is provided with a head having a plurality of liquid discharge parts having nozzles collaterally arranged therein, and in particular, to an apparatus for discharging liquid which has line heads, and to a method for discharging liquid employing the apparatus for discharging liquid which has line heads.

Conventionally, there is known an ink jet liquid discharge apparatus as an apparatus for discharging liquid which is provided with a head having a plurality of liquid discharge parts having nozzles collaterally arranged therein. Such ink jet liquid discharge apparatuses are classified into those of thermal system, those of piezoelectricity system, etc. in view of the difference of liquid discharge manner. Among those, there is widely known a thermal ink jet printer as an apparatus for discharging liquid of thermal system.

As a thermal ink jet printer, there is known a printer which is provided with a printer head having discharge orifices for discharging or spraying liquid ink being liquid in the form of released droplets (referred to also as droplets, hereinafter), ink passes communicating with the discharge orifices, and electro-thermal conversion elements for supplying discharge energy to form droplets which are arranged on the ink passes. The printer employs the serial scan system in which the printer head is scanned or moved along a direction perpendicular to the feed direction of a print paper to print an image.

In the conventional printer, drive pulses are applied to the electro-thermal conversion elements every time the printer head shifts to a print point. As the drive pulses are applied to the electro-thermal conversion elements, liquid ink in the ink passes is supplied with discharge energy, which causes the discharge orifices to discharge the liquid ink in the form of released droplets. Then, an image is printed when thus discharged droplets hit a print paper and form dots.

The printer forms dots on a print paper so that dot matrixes are formed on the print paper when the printer head shifts to a print point. Characters, images, etc. are formed on a print paper using thus formed dot matrixes.

Generally, the printer head used in the printer has a plurality of discharge orifices arranged along a direction (secondary scan direction) perpendicular to the shift direction (main scan direction). In the printer, all the electro-thermal conversion elements can be driven concurrently when printing an image. However, in case all the electro-thermal conversion elements are concurrently driven when printing an image, the burden of a power source unit which supplies power to the printer head is caused to be enlarged. So, time division drive is generally employed in which the plural electro-thermal conversion elements are divided into several blocks, and thus divided electro-thermal conversion elements are sequentially driven every divided block.

On the other hand, a printer generally performs gradation expression under image processing such as the error diffusion method to print an image on a print paper. Generally, a printer employs various image quality modes. For example, a printer employs a mode of printing one line along the main scan direction using one nozzle, and a mode of printing one line along the main scan direction using a plurality of nozzles utilizing the shift operation of a print paper which is fed along the secondary scan direction. When printing an image with high quality, a printer employs the latter mode of printing one line using a plurality of nozzles and reduces shift length of a print paper along the secondary scan direction to perform correction processing so as to make dispersion of hit positions of dots such as banding indistinguishable.

There is a line type printer head which can concurrently print an image along the width direction of a print paper. The line type printer head, being different from a serial type printer head, does not shift along the main scan direction. Instead, the line type printer head itself or a print paper shifts only along the secondary scan direction. Thus, the number of nozzles of the line type printer head along the line direction becomes very large (in 600 dpi pitch, 5100 nozzles for 8.5 inch width). So, the configuration of the line type printer head can be simplified by using head chips in which heaters, etc. for a plurality of nozzles are formed on one semiconductor substrate.

In performing multiple gradation printing, the line type printer head cannot use a printing method used in the serial type printer head. As a printing method of the line type printer head, the PNM (pulse number modulation) system is considered to be effective in which small drop dots composed of a plurality of released droplets repeatedly hit a print paper. However, in case of employing the PNM system, the number of discharge pulses per pixel becomes undesirably large, and "the number of nozzles"×"the number of pulses" is required to be controlled in view of the number of nozzles of the line type printer head, which necessarily and undesirably increases electric power consumption as compared with the serial type printer head.

Furthermore, in performing multiple gradation printing using the line type printer head, since the line type printer head does not shift along the main scan direction, respective nozzles print respective lines. Thus, since the line type printer head cannot use a printing method used in the serial type printer head, printed image is deteriorated due to unevenness, stripes, etc. caused by dispersion of hit positions of dots.

Moreover, in using the line type printer head, since time division drive is employed, discharge timing is undesirably varied. Thus, shear of dot positions is undesirably raised along the main scan direction, which also deteriorates printed image.

The present applicant proposed a method for driving a recording head and a recording head in Japanese Laying-Open Patent 2000-014236, which can reduce shear of dot positions on a print paper as well as lower momentary maximum electric power consumption in performing time division drive. In the Japanese Laying-Open Patent 2000-014236, heater elements are used as drive elements for discharging liquid ink, and a recording head provided with a plurality of recording elements over approximately the width direction of a print paper, which is perpendicular to the feed direction thereof, is used. The plural recording elements are driven under time division drive every constant unit respectively using division drive signals which have their phases shifted for the plural recording elements to cause droplets of liquid ink to hit a print paper. Thus, a plurality of dots are formed on a print paper and an image is printed thereon.

When using head chips in which heaters, etc. for a plurality of nozzles are formed on one semiconductor substrate, dispersion of property cannot be prevented. In case the dispersion of property is large, an image is printed with different density with adjoining parts of adjacent head chips being borders. Thus, in case of printing background using a single color, vertical stripes may be raised at the borders of adjacent head chips along the feed direction of a print paper, which undesirably deteriorates printed image.

The present applicant proposed a printer and a printer head in Japanese Laying-Open Patent 2000-229050 which can prevent deterioration of printed image due to dispersion of property of head chips. In the Japanese Laying-Open Patent 2000-229050, nozzles allocated to head chips are so arranged as to overlap at parts of adjacent head chips when viewed from the feed direction of a print paper. That is, deterioration of printed image due to dispersion of property of head chips can be prevented by employing tiling which has overlapped parts formed therein.

On the other hand, when simply driving line heads employing the tiling which has overlapped parts formed therein under time division drive so as to take advantage of merit of time division drive of line heads and that of the tiling which has overlapped parts formed therein, a problem that coloring of superposed colors at overlapped parts becomes different from that at non-overlapped parts due to difference of degree of dryness is raised.

SUMMARY OF THE INVENTION

Accordingly, the present invention has an object to overcome the above-mentioned drawbacks of the prior art by providing an apparatus and a method for discharging liquid which can print the tiling part in the hound's tooth manner in driving line heads employing the tiling which has overlapped parts formed therein under time division drive.

Furthermore, the apparatus and method for discharging liquid of the present invention can prevent the problem that coloring of superposed colors at overlapped parts becomes different from that at non-overlapped parts.

The above object can be attained by providing an apparatus for discharging liquid which is provided with a head having liquid discharge parts for discharging droplets from nozzles, wherein the head has a plurality of head chips staggeringly arranged thereon, the plural head chips having a plurality of the liquid discharge parts collaterally arranged therein, and wherein the plural head chips are so arranged in the staggering manner as to overlap at parts of adjacent head chips when viewed from the feed direction of a recording medium, and the distance between nozzles of staggeringly arranged adjacent head chips is set to be even number multiple of one pitch which corresponds to a feed length for one line of the recording medium.

Furthermore, the above object can also be attained by providing an apparatus for discharging liquid which is provided with a head having liquid discharge parts for discharging droplets from nozzles, wherein the head has a plurality of head chips staggeringly arranged thereon for each color of droplets, the plural head chips having a plurality of the liquid discharge parts collaterally arranged therein, and wherein the plural head chips are so arranged in the staggering manner as to overlap at parts of adjacent head chips when viewed from the feed direction of a recording medium, and the distance between nozzles of staggeringly arranged adjacent head chips which form dots of the same color is set to be even number multiple of one pitch which corresponds to a feed length for one line of the recording medium as well as the distance between nozzles of head chips which form dots of different color is set to be even number multiple of one pitch which corresponds to a feed length for one line of the recording medium.

Furthermore, the above object can also be attained by providing a method for discharging liquid which discharges droplets from nozzles, wherein a plurality of head chips are staggeringly arranged, the plural head chips having a plurality of liquid discharge parts for discharging droplets from nozzles collaterally arranged therein, wherein the plural head chips are so arranged in the staggering manner as to overlap at parts of adjacent head chips when viewed from the feed direction of a recording medium, and wherein droplets are discharged from the nozzles, the distance between nozzles of staggeringly arranged adjacent head chips being set to be even number multiple of one pitch which corresponds to a feed length for one line of the recording medium.

Furthermore, the above object can also be attained by providing a method for discharging liquid which discharges droplets from nozzles, wherein a plurality of head chips are staggeringly arranged for each color of droplets, the plural head chips having a plurality of liquid discharge parts for discharging droplets from nozzles collaterally arranged therein, wherein the plural head chips are so arranged in the staggering manner as to overlap at parts of adjacent head chips when viewed from the feed direction of a recording medium, and wherein droplets are discharged from the nozzles, the distance between nozzles of staggeringly arranged adjacent head chips which form dots of the same color being set to be even number multiple of one pitch which corresponds to a feed length for one line of the recording medium as well as the distance between nozzles of head chips which form dots of different color being set to be even number multiple of one pitch which corresponds to a feed length for one line of the recording medium.

DETAILED DESCRIPTION OF THE PRESENTLY PREFERRED EMBODIMENTS

The present invention will further be described below concerning the best modes with reference to the accompanying drawings.

Figure 1:
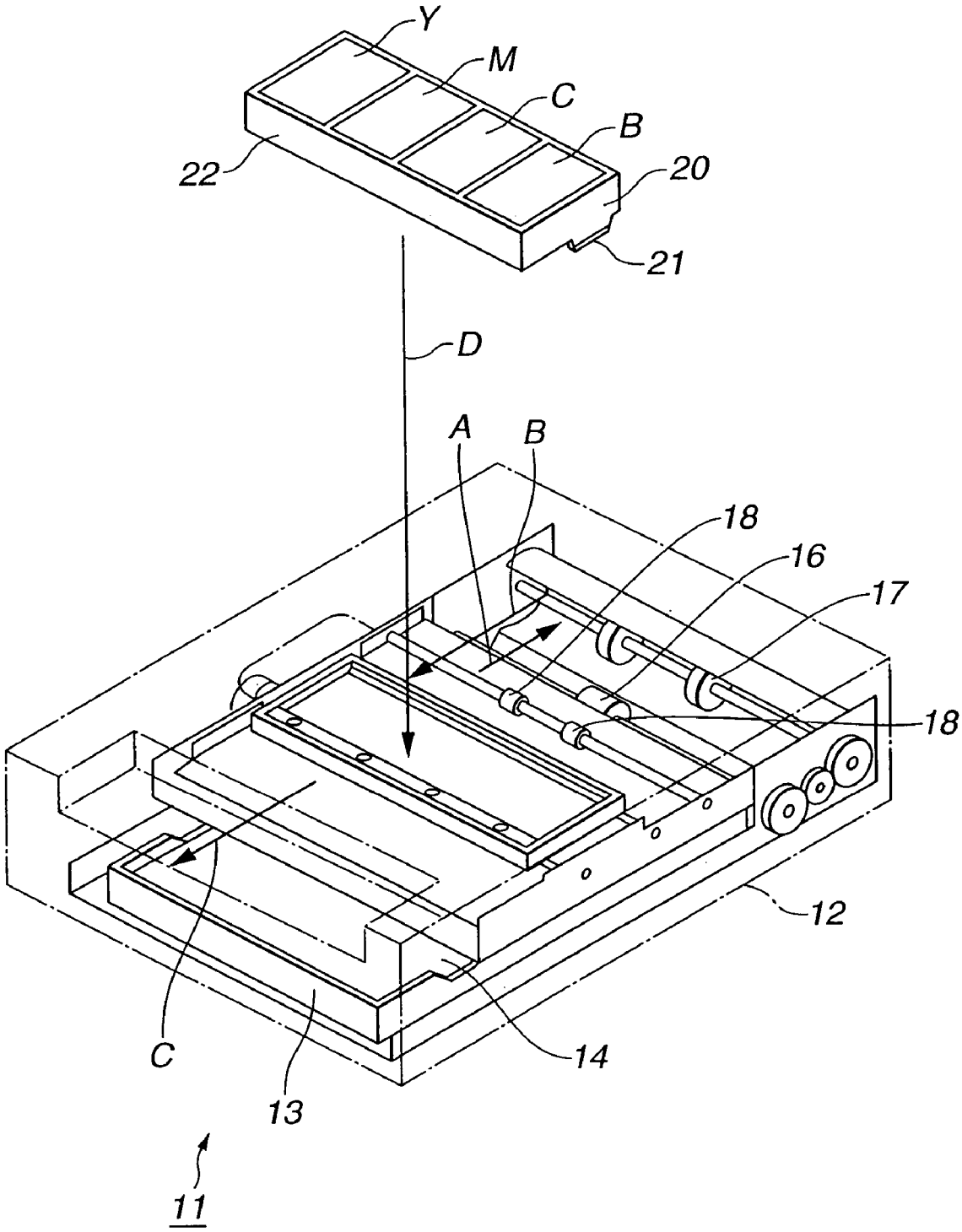
FIG. 1 shows a perspective view of a line color printer employing the present invention.

The present invention can be applied to a line color printer 11 configured as shown in FIG. 1. The line color printer 11 has a housing 12 of a rectangular shape for enclosing inside parts or components thereof, and a paper feed tray 13 for storing print papers 14. The paper feed tray 13 is installed into the line color printer 11 from the tray entrance formed at the front side of the housing 12, which enables the line color printer 11 to be fed with the print papers 14.

When the paper feed tray 13 is installed into the line color printer 11 from the tray entrance of the housing 12, the print papers 14 are pushed and brought into contact with a paper feed roller 16 by a predetermined mechanism. When the paper feed roller 16 rotates, the print papers 14 are fed toward the rear side of the line color printer 11 from the paper feed tray 13 along an arrow A shown in FIG. 1. Also, the line color printer 11 has reverse rollers 17 arranged near the rear side of the line color printer 11. When the reverse rollers 17 rotate, the feed direction of the print papers 14 is changed and the print papers 14 are fed toward the front side of the line color printer 11 along an arrow B shown in FIG. 1.

Then, the print papers 14 whose feed direction is changed are fed by spur rollers 18, etc. arranged over the paper feed tray 13, and are delivered from a paper outlet formed at the front side of the housing 12 along an arrow C shown in FIG. 1. The line color printer 11 has a replaceable head cartridge 20 arranged therein between the spur rollers 18 and the paper outlet as shown by an arrow D shown in FIG. 1.

The head cartridge 20 has a head 21 which has line heads of yellow, magenta, cyan, and black arranged therein, and a holder 22 of a predetermined shape the bottom of which holds the head 21. Also, the holder 22 has ink cartridges Y, M, C, and B, or yellow, magenta, cyan, and black arranged therein. Thus, the line color printer 11 can print an image such as images by causing droplets of liquid ink of respective colors from corresponding line heads to hit the print papers 14.

Figure 2:
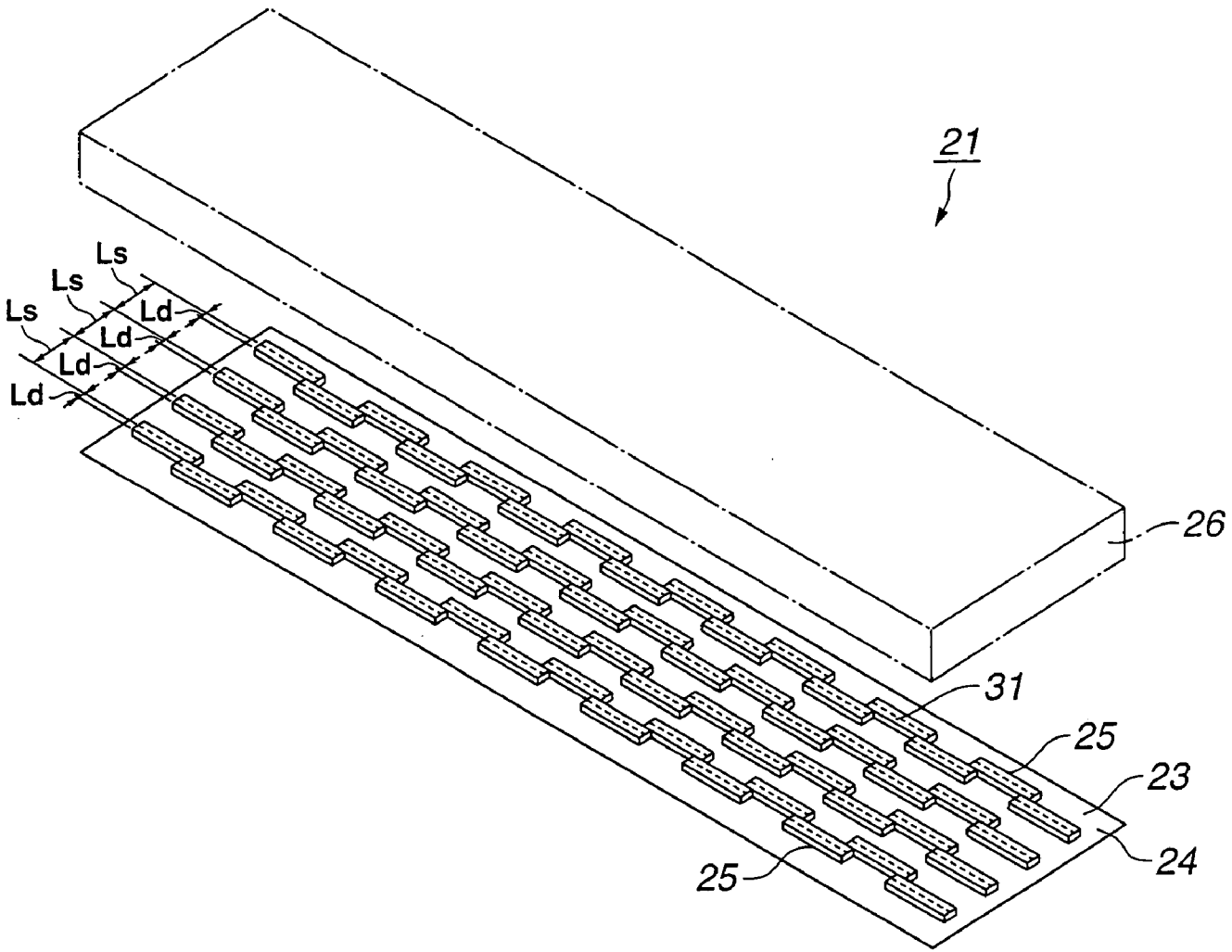
FIG. 2 shows an exploded perspective view of a head of the line color printer.

FIG. 2 shows an exploded perspective view of the head 21 when viewed from the same direction as FIG. 1. The head 21 has an orifice plate 23 which is prepared by forming nozzles on a sheet material made of carbonaceous resin, and the orifice plate 23 is held by a frame not shown. The head 21 has a dry film 24 of a predetermined shape made of similar carbonaceous resin arranged on the orifice plate 23, and has head chips 25 arranged on the dry film 24.

In the head 21, four lines of line heads which consist of head chips 25 and correspond to yellow, magenta, cyan, and black, respectively, are arranged along the longitudinal direction of the head 21. The head 21 has a metal plate 26 which has its surface of the head chips 25 side worked under convexoconcave processing, and in which ink passes are formed through which ink flows from the ink cartridges to the head chips 25. The respective head chips 25 are connected to the metal plate 26.

Figure 3:
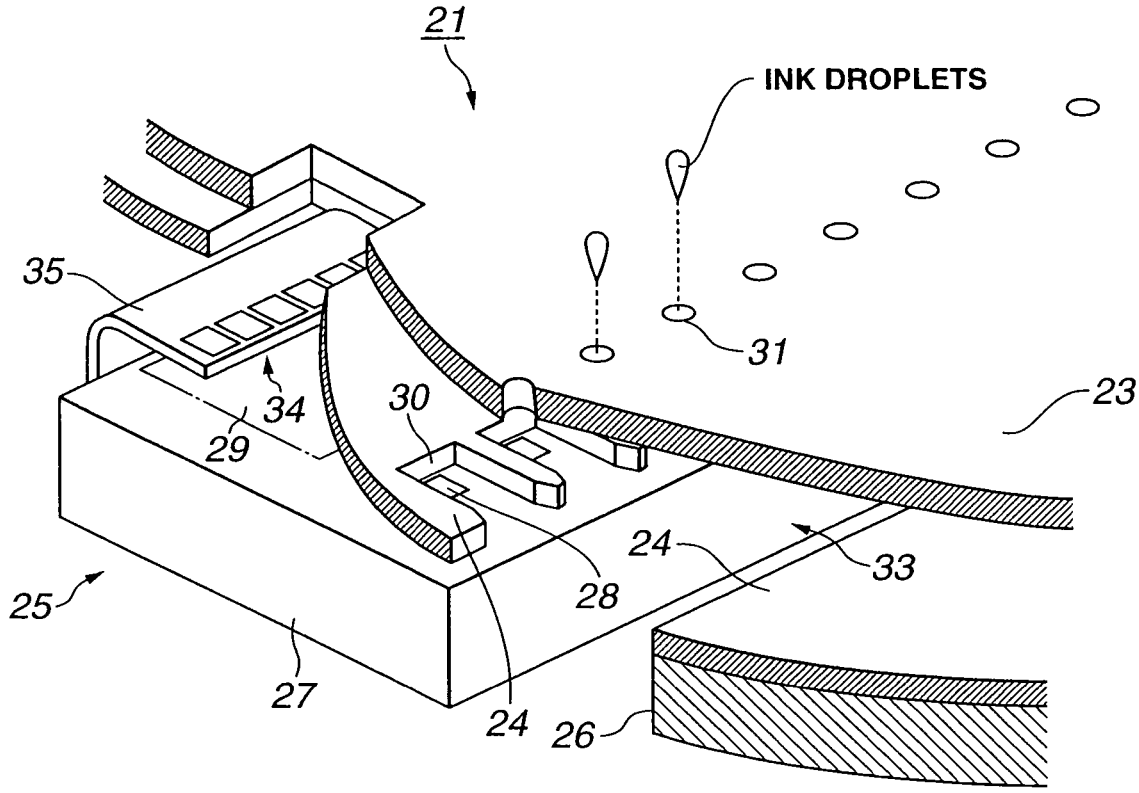
FIG. 3 shows a detailed perspective view of the head.

FIG. 3 shows a perspective view of the head chip 25 arranged in the head 21. In FIG. 3, the head chip 25 is shown with peripheral components. The head chip 25 is prepared by working a silicon substrate 27 employing the integrated circuit technique. The head chip 25 has heaters 28 for heating ink sequentially arranged thereon forming a line, and a heater drive circuit 29 for driving the heaters 28. In the head 21, the orifice plate 23 is arranged and worked such that circular orifices formed therein are located directly over the respective heaters 28. Also, in the head 21, partition walls for partitioning respective heaters 28 are formed by working the dry film 24, and thus ink cells 30 for the respective heaters 28 are formed. The circular orifices formed in the orifice plate 23 configures nozzles 31 for discharging ink droplets.

In the head chip 25, the dry film 24 is worked so that the partition walls forms a pectinate shape, which allows the ink cells 30 to communicate with an ink pass 33. The heaters 28 are arranged in the vicinity of the innermost walls of the pecten-shaped partition walls.

In the head 21, the ink pass 33 is formed by working the metal plate 26 and the dry film 24 so that ink of ink cartridges Y, M, C, and B is led to the opened sides of the ink cells 30. Thus, in the head 21, ink is led to the ink cells 30 for the respective heaters 28 from the edge side along the longitudinal direction of the head chip 25.

Also, the head chip 25 has a pad 34 formed at a side opposite to that where the heaters 28 are arranged, and a flexible wiring substrate 35 is connected to the pad 34 to perform drive operation. Thus, in the head 21, a mechanism for discharging ink droplets from nozzles are formed.

Figure 4:
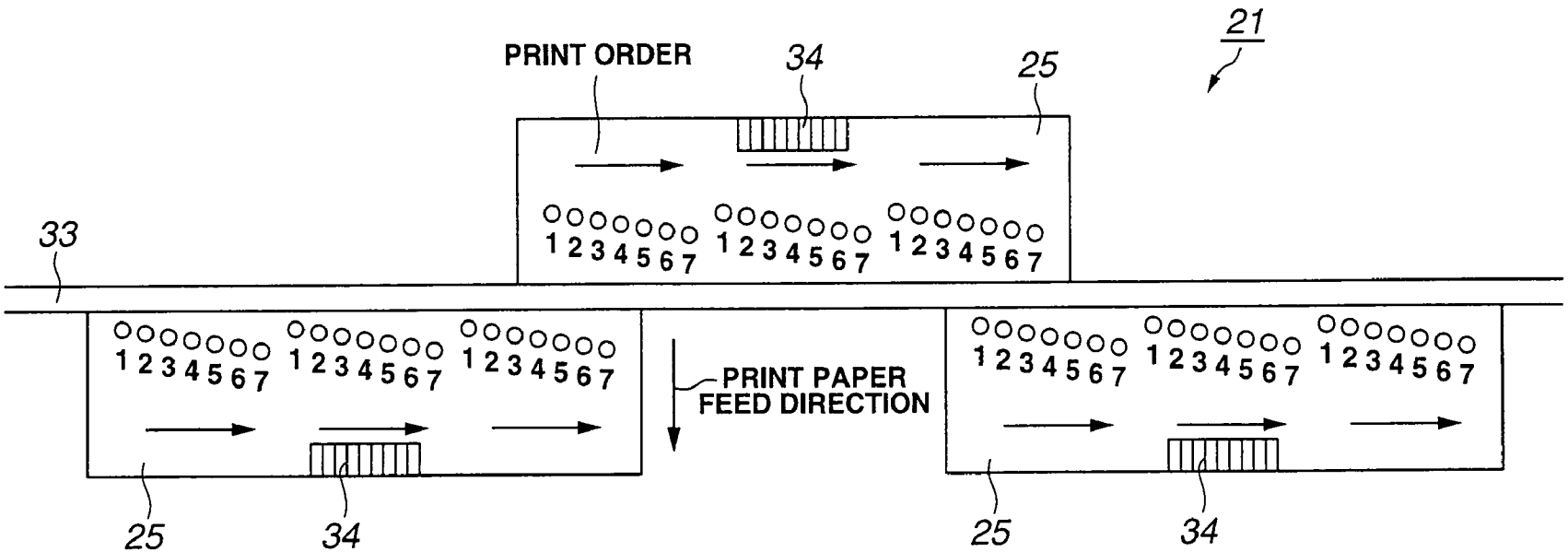
FIG. 4 shows a plan view indicating arrangement of head chips of the head.

FIG. 4 shows an enlarged view of part of the head 21 viewed from the feed direction of the print papers 14, which also shows arrangement of the head chips 25. As shown in FIG. 4, the head 21 has the head chips 25 of the same configuration staggeringly arranged thereon at both sides of the ink pass 33 of the respective ink. Furthermore, the respective head chips 25 are arranged at both sides of the ink pass 33 such that the same sides or nozzle-forming sides thereof face the ink pass 33, which allows ink to be led from the ink pass 33 to the respective head chips 25. Thus, the head 21 is configured so that the respective head chips 25 are supplied with ink using only single ink pass 33. So, printing accuracy can be improved to realize high resolution under simplified configuration.

The respective head chips 25 have their pads 34 located at the center positions thereof along the direction of arranging the nozzles 31 so that positions of the pads 34 are not changed along the direction of arranging the nozzles 31 even though the respective head chips 25 face the ink pass 33. Thus, in the head 21, convergence of the flexible wiring substrates 35 to be connected to the pads 34 can be prevented.

In the head 21, the nozzles 31 are divided into groups each has nozzles 31 of a predetermined number. Also, in each group, the nozzles 31 are so formed on the orifice plate 23 as to make offsets therebetween along the feed direction of a print paper. Also, the heaters 28 of the head chips 25 are so formed on positions shifted along the feed direction of a print paper as to correspond the respective nozzles 31 of the respective groups formed on the orifice plate 23 with the predetermined number of nozzles 31 of the respective groups being a unit. In FIG. 4, offset values of the nozzles 31 are exaggeratively shown. Also, in FIG. 4, the nozzles 31 are divided into three groups with seven nozzles 31 being a unit for the convenience of simplifying the explanation.

In the head chips 25, thus grouped heaters 28 are sequentially driven by effectively utilizing the position shifts of nozzles 31 which make offsets along the feed direction of a print paper. In case the nozzles 31 make offsets, since the head chips 25 face the ink pass 33, drive order of heaters 28 becomes opposite to input order of drive signals. In this embodiment, to cope with the situation, the head chips 25 are so configured as to be able to change the drive order of drive circuits.

Figures 5A, 5B, 5C, 5D:
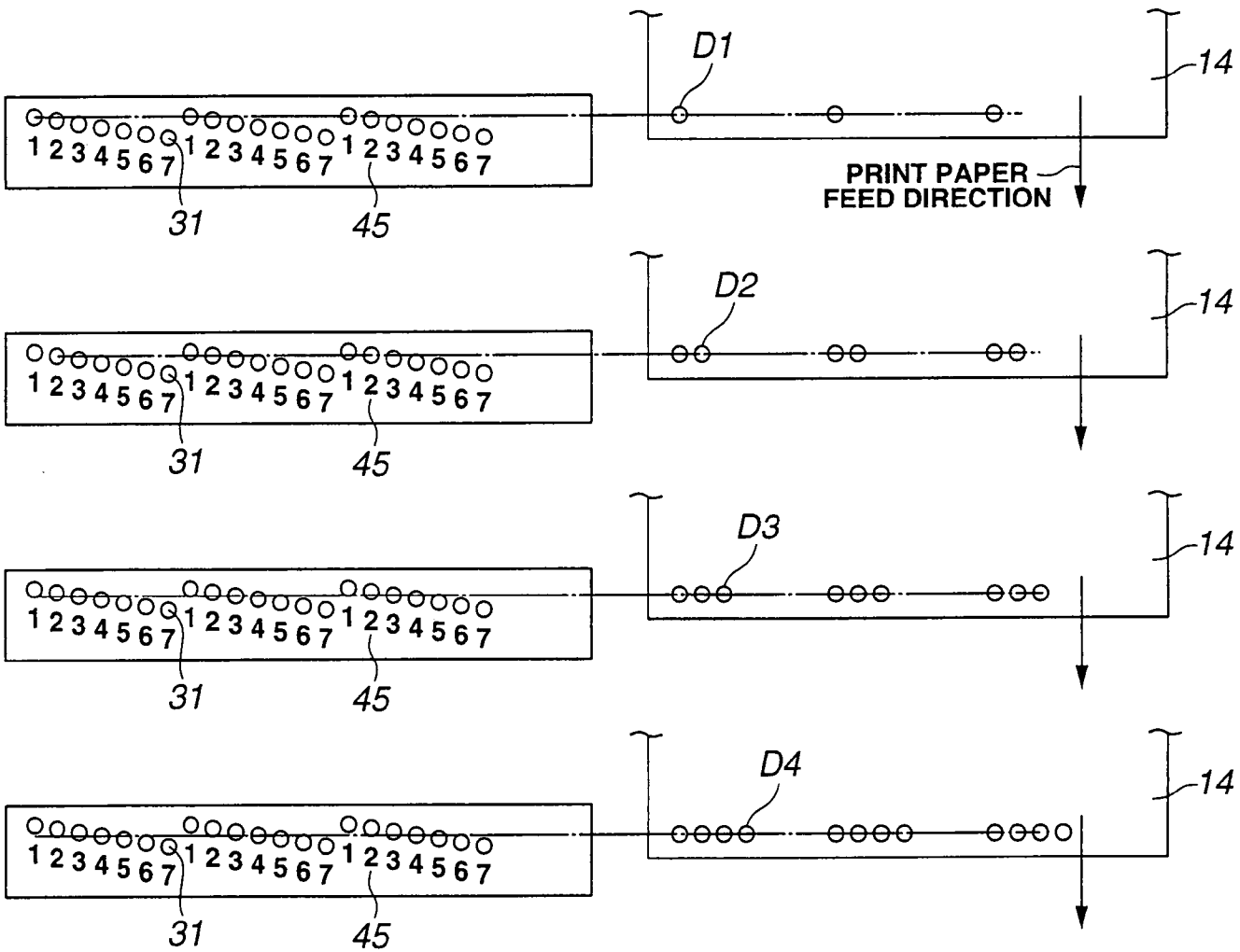
FIG. 5A to FIG. 5G show plan views indicating drive operation of the head chips.
Figure 5E:
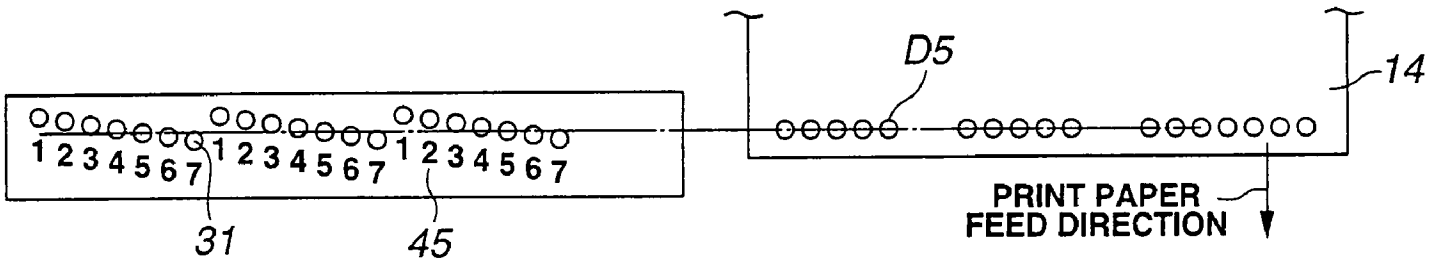
Figure 5F:
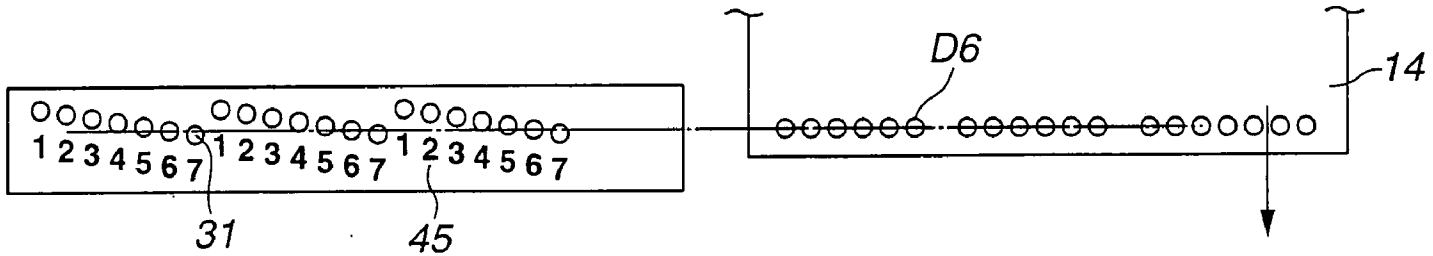
Figure 5G:
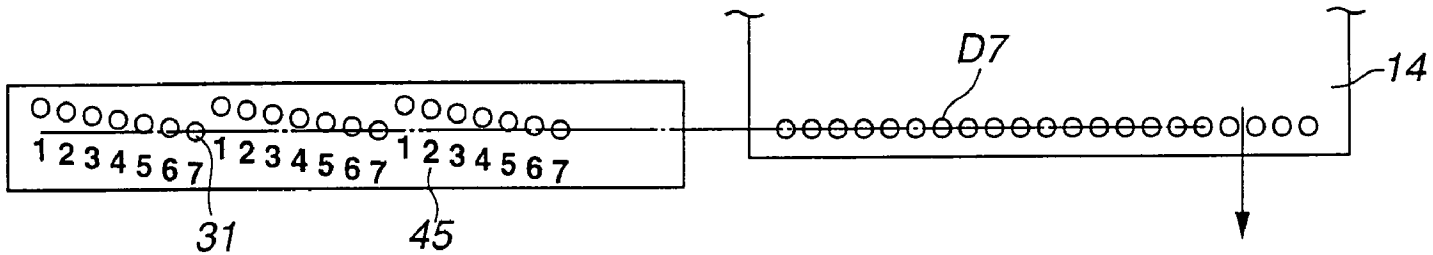

In the line color printer 11, nozzles 31 which are made up of groups of seven nozzles are sequentially controlled from nozzles 31 located at the incoming side of the print paper 14 under phases of phase 1 to phase 7, as shown in FIG. 5A to FIG. 5G. In FIG. 5A to FIG. 5G, numerals corresponding to the respective phases are put to the nozzles. When the print paper 14 is fed, nozzles 1 which the incoming side of the print paper 14 firstly reaches are driven under the phase 1 to form dots D1, as shown in FIG. 5A. Next, when the print paper 14 is fed by a shift length from nozzles 1 to nozzles 2, nozzles 2 which the incoming side of the print paper 14 secondly reaches are driven under the phase 2 to form dots D2, as shown in FIG. 5B. Furthermore, similarly, nozzles 3 to nozzles 7 are sequentially driven under the phase 3 to the phase 7 to form dots D3 to dots D7, as shown in FIG. 5C to FIG. 5G, respectively.

Under this processing, in the line color printer 11, nozzles 31 in one group are driven with respective drive timing shifted, and corresponding nozzles 31 in respective groups are driven concurrently in parallel.

Furthermore, the head 21 forms one dot using plural droplets, and varies the size of the dot by changing the number of droplets which form the dot. Thus, gradation expression is performed. In this embodiment, eight droplets are used in forming one dot at the most.

In the head 21, a plurality of head chips are so arranged as to overlap at parts of adjacent head chips, that is parts of a plurality of nozzles allocated to one head chip overlap with parts of a plurality of nozzles allocated to adjacent head chips when viewed from the feed direction of a printing object or a print paper, so that ink droplets from adjacent nozzles hit substantially the same position on the printing object.

Thus, in the line color printer 11, mixed dots by adjacent two head chips are formed at overlapped parts. These mixed dots make dispersion of property between adjacent head chips indistinguishable, which can prevent deterioration of printed image.

Figures 9A, 9B, 9C, 9D:
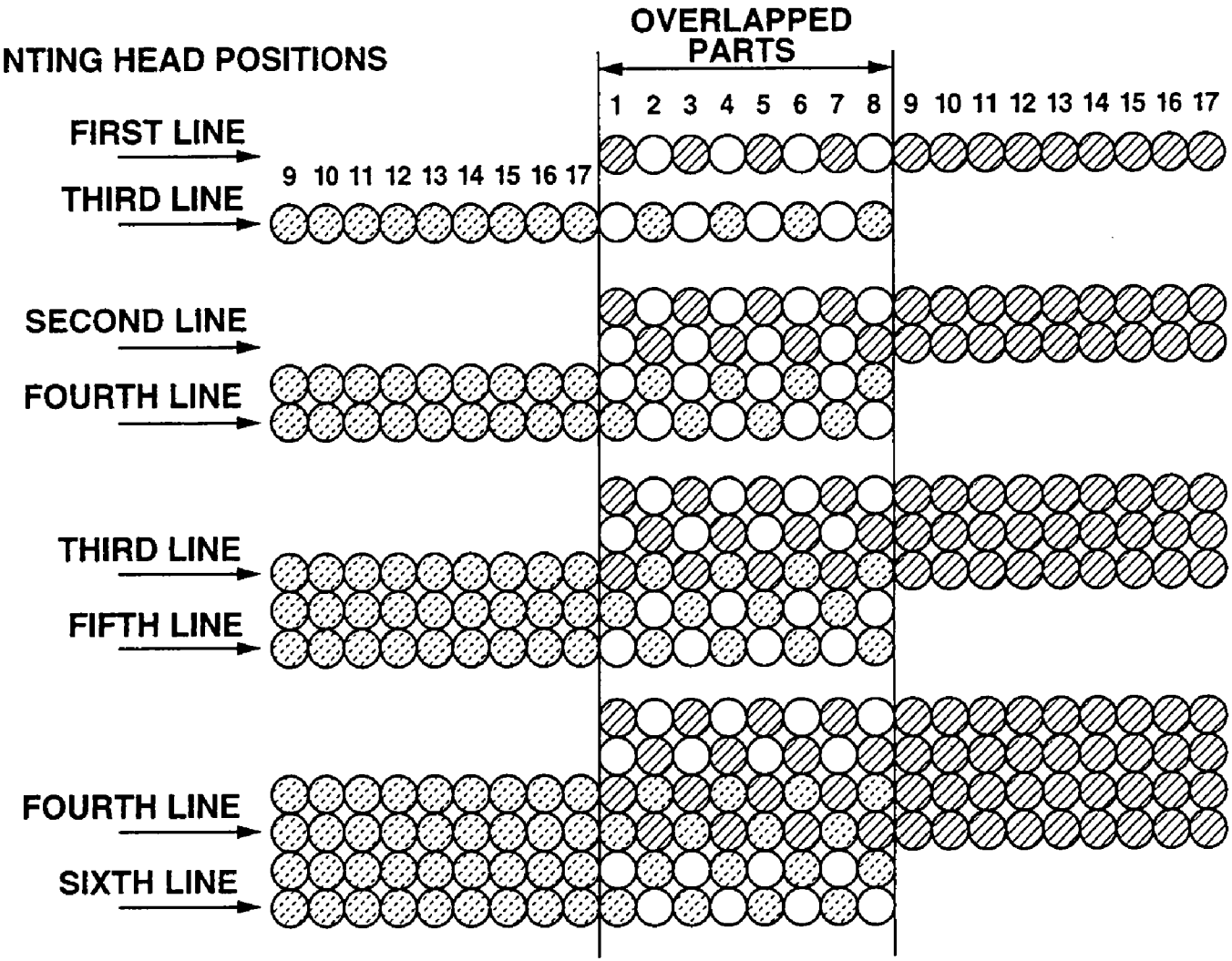
FIG. 9A to FIG. 9D show plan views indicating the printed dot state formed by head chips of the same color of the line color printer.

In the line color printer 11, the distance $L_s$ between nozzles of adjacent head chips of the same color is set to be even number pitches. And, the distance $L_d$ between nozzles of head chips of different color is set to be even number pitches. One pitch corresponds to a feed length of a printing object for printing an image of one line. For example, in FIG. 9 to be described later, data of one line is printed as shown in FIG. 9C. So, the printing object is fed by two lines from the state shown in FIG. 9A. That is, in the example shown in FIG. 9A to 9D, the distance $L_s$ between nozzles of adjacent head chips of the same color is set to be two lines being even number pitches.

Figure 6:
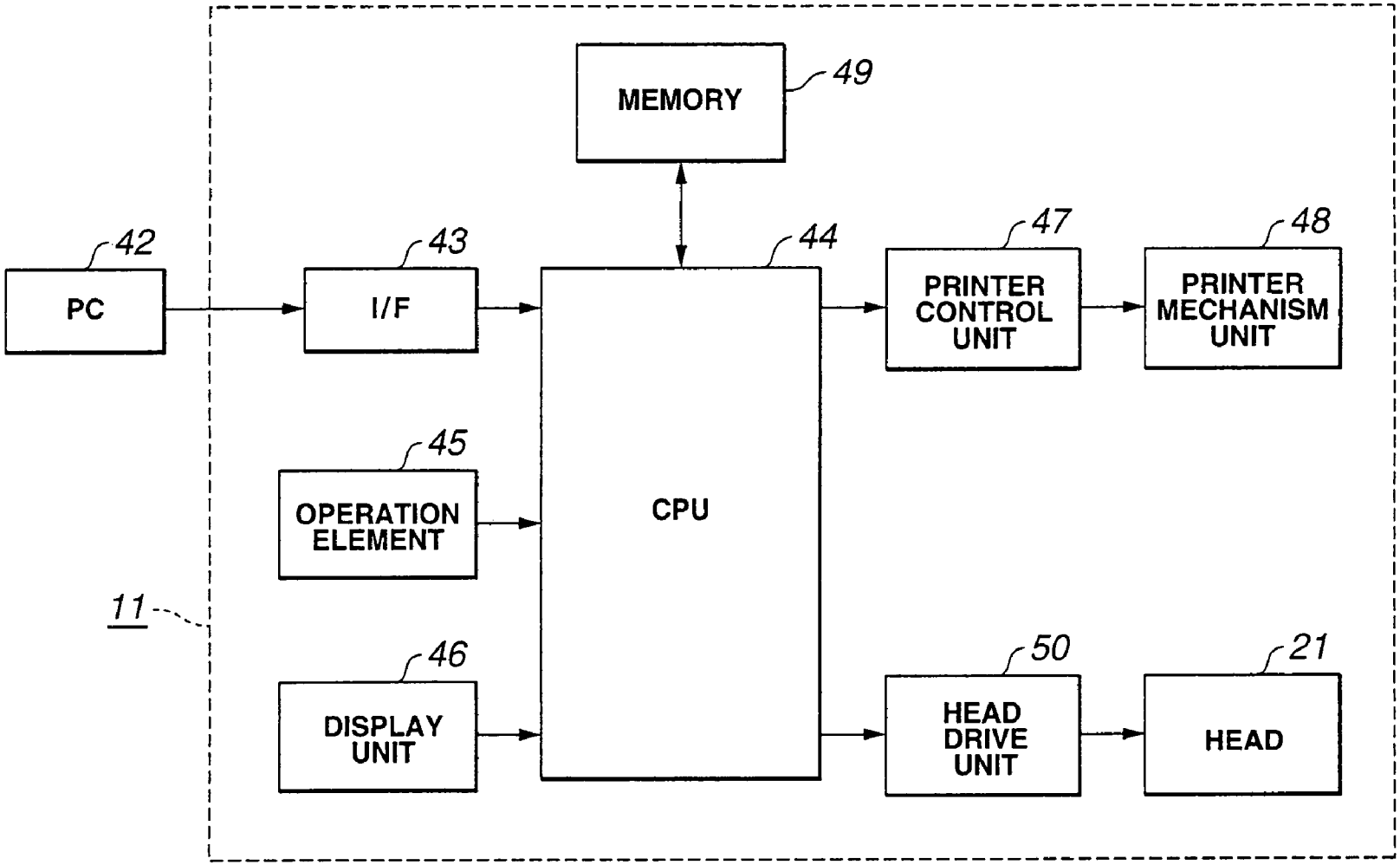
FIG. 6 shows a block diagram indicating configuration of the line color printer.

FIG. 6 shows a block diagram indicating configuration of the line color printer 11.

In the line color printer 11, an interface (I/F) 43 receives control commands, text data, image data, etc. output from a personal computer 42 being a host apparatus, and sends thus received commands, data, etc. to a central processing unit (CPU) 44. An operation element 45 is a push-type operation element arranged on a operation panel of the line color printer 11. The line color printer 11 can accept various settings of printing position, etc. and various instructions of test printing, etc. when the user operates the operation element 45. A display unit 46 may be a liquid crystal display panel arranged on the operation panel, and can display menu of various settings, detailed information, etc. corresponding to operations of the operation element 45.

A printer mechanism unit 48 may be a print paper feed mechanism of the line color printer 11, and a printer control unit 47 controls operation of the printer mechanism unit 48 under the control of the central processing unit 44. A head drive unit 50 is composed of drive circuits for driving respective head chips of the head 21 under the control of the central processing unit 44. Thus, the line color printer 11 can print color images by driving the head 21 with the print papers 14 fed by the printer mechanism unit 48 under the control of the central processing unit 44 corresponding to output data from the personal computer 42.

The central processing unit 44 configures a controller for controlling operation of the line color printer 11 together with a memory 49, and analyzes control commands received through the interface 43 as well as controls operation of the printer control unit 47 and the head drive unit 50 by processing text data and image data based on the analysis result so as to print the text data and image data.

In the line color printer 11, the head drive unit 50 drives the head 21 so that mixed dots by adjacent two head chips are formed at overlapped parts.

Figure 7:
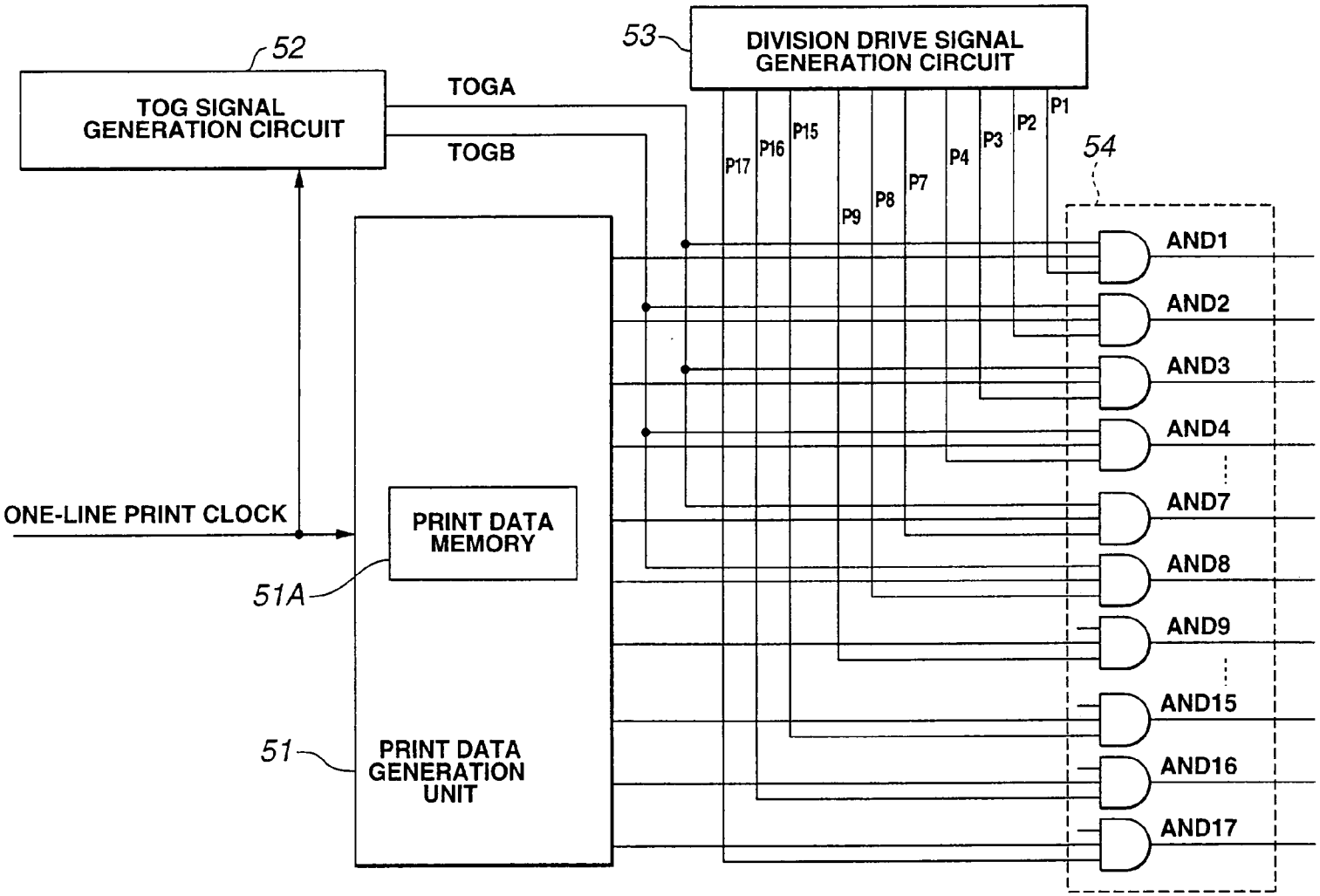
FIG. 7 shows a block diagram indicating configuration of a head drive unit on head chip unit.

The head drive unit 50 has a print data generation unit 51, a TOG signal generation circuit 52, a division drive signal generation circuit 53, and a gate circuit 54, as shown in FIG. 7 which indicates configuration of the head drive unit 50 on head chip unit.

The print data generation unit 51 stores print data sent from the central processing unit 44 into a print data memory 51A, and generates head control data indicative of discharge/non-discharge status of respective nozzles for each one-line print clock based on the print data.

The head control data generated from the print data generation unit 51 is sent to first to N-th (N being 17 in this embodiment) AND gate circuits or AND 1 to AND 17 of the gate circuit 54.

The TOG signal generation circuit 52 generates a TOG signal TOGA and a TOG signal TOGB having opposite phases respectively which are to be inverted for each one-line print clock in synchronization with the one-line print clock. The TOG signal TOGA generated by the TOG signal generation circuit 52 is sent to the AND gate circuits AND 1, AND 3, AND 5, AND 7, while the TOG signal TOGB generated by the same TOG signal generation circuit 52 is sent to the AND gate circuits AND 2, AND 4, AND 6, AND 8. The TOG signal TOGA and the TOG signal TOGB generated by the TOG signal generation circuit 52 have their phases caused to be opposite according to head chips.

Furthermore, the division drive signal generation circuit 53 generates division drive signals P1 to P17 whose timing is obtained by dividing one period of one-line print clock or one-line print period by n (n being 17 in this embodiment). The division drive signals P1 to P17 generated by the division drive signal generation circuit 53 are sent to the AND gate circuits AND 1 to AND 17 of the gate circuit 54.

Then, outputs from the AND gate circuits AND 1 to AND 8 of the gate circuit 54 are sent to heater drive circuits of nozzles for generating dots at overlapped parts where dots to be formed by adjacent head chips of the same color overlap, while outputs from the AND gate circuits AND 9 to AND 17 of the same gate circuit 54 are sent to heater drive circuits of nozzles for generating dots at non-overlapped parts.

Figure 8:
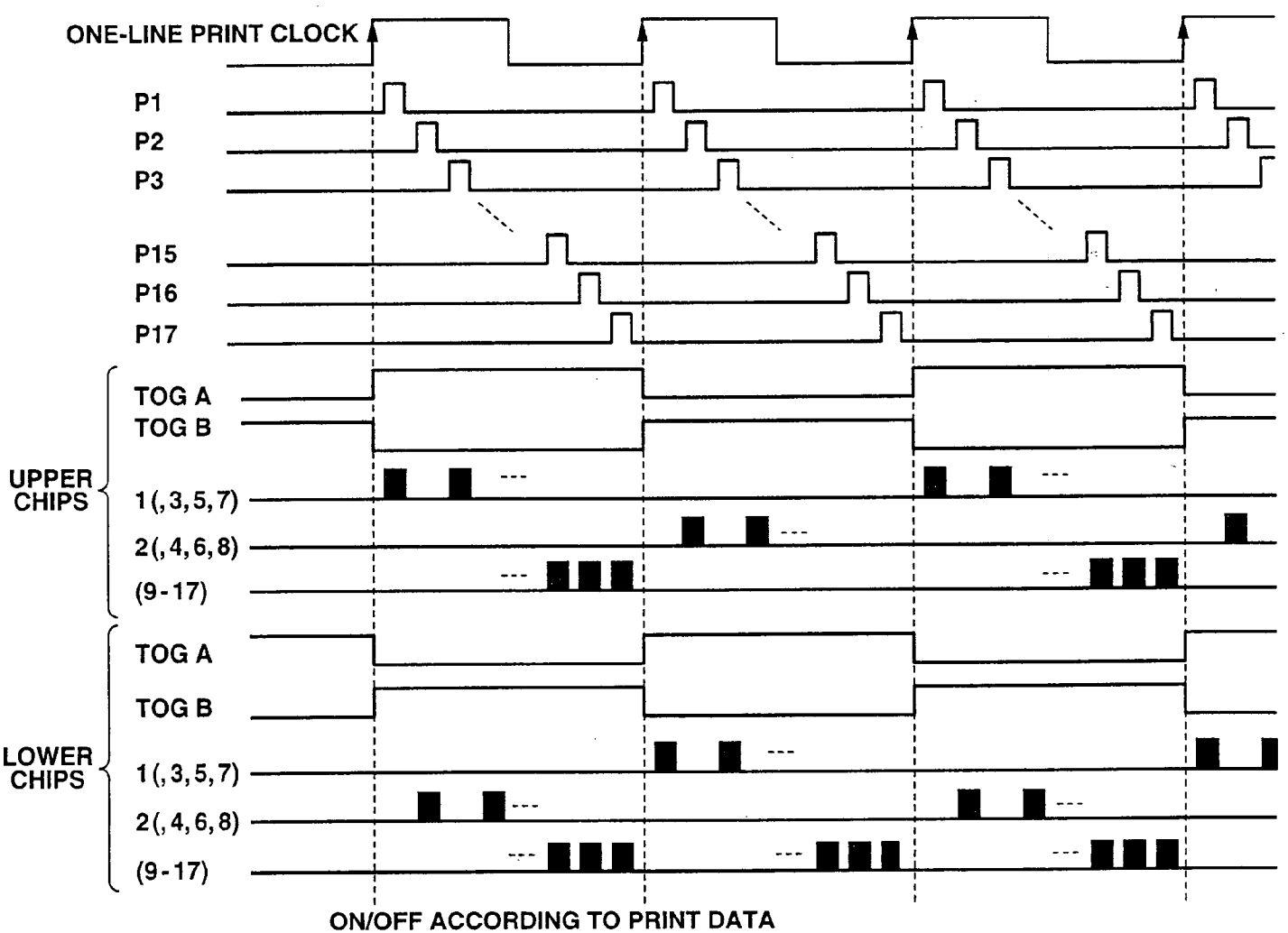
FIG. 8 shows a timing chart indicating the drive state of the respective head chips driven by the head drive unit.

FIG. 8 shows a timing chart which indicates the drive state of the respective head chips driven by the head drive unit 50.

In thus configured line color printer 11, the print paper 14 stored in the paper feed tray 13 is drawn by the paper feed roller 16, and has its feed direction changed by the reverse rollers 17 to be fed toward the paper outlet formed at the front side of the housing 12. When the print paper 14 is fed toward the paper outlet, ink cartridges of yellow, magenta, cyan, and black Y, M, C, and B held by the head cartridge 20 supplies corresponding ink to line heads of the head 21, and droplets formed out of the ink hit the print paper 14 to print desired images.

In the respective line heads of the head 21, ink from the ink cartridges Y, M, C, and B is led to the ink cells 30 through corresponding ink passes 33. Then, the ink is discharged from the nozzles 31 by means of bubbles generated at the ink cells 30 when the heaters 28 heat up, and droplets formed out of the ink hit the print paper 14. Thus, the line color printer 11 can print desired images.

The silicon substrate 27 of the head 21 has the heaters 28 sequentially arranged thereon, and has the heater drive circuit 29, thereby forming the head chip 25.

Furthermore, as has been described above, the nozzles 31 are divided into groups each has nozzles of a predetermined number=in the head chip 25, and the nozzles 31 are so formed as to make offsets. Thus, in the line color printer 11, nozzles 31 in one group are driven with respective drive timing shifted to secure temporal allowance, while corresponding nozzles 31 in respective groups are driven concurrently in parallel so as to reduce time required to print an image.

Furthermore, in the line color printer 11, adjacent head chips form overlapped parts, and ink droplets from adjacent nozzles hit substantially the same position of overlapped parts on a printing object. Thus, in the line color printer 11, mixed dots by adjacent two head chips are formed at overlapped parts on a printing object. These mixed dots make dispersion of property between adjacent head chips indistinguishable, which can prevent deterioration of printed image.

In the line color printer 11, text data and image data output from the personal computer 42 is sent to the central processing unit 44 through the interface 43, and the central processing unit 44 controls the printer control unit 47 and the head drive unit 50 based on thus sent and received data so as to drive the head 21 with the print paper 14 fed along the predetermined feed direction of a print paper. Thus, characters and images generated from the received data are printed on the print paper 14.

In the line color printer 11, as has been described above, the distance $L_s$ between nozzles of adjacent head chips of the same color is set to be even number pitches, and timing of printing dots at overlapped parts where dots to be formed overlap are set to be opposite phases. Thus, as shown in FIG. 9A to FIG. 9D, dots are formed in the hound's tooth manner at overlapped parts where dots formed by adjacent head chips of the same color overlap. When dots are formed over three lines or more, as shown in FIG. 9C, dots are formed at blank parts of the hound's tooth pattern. In the example shown in FIG. 9A to FIG. 9D, the number of concurrently driven head chips is thirteen at the most, respectively.

As shown in FIG. 9A to FIG. 9D, the distance $L_s$ between nozzles of adjacent head chips of the same color is set to be two lines, that is interval of dot lines printed by adjacent head chips of the same color corresponds to one dot on a print paper, and an image is printed with the print paper 14 fed by one line for respective print processing.

That is, FIG. 9A shows the state in which half of the first line and half of the third line are printed. FIG. 9B shows the state in which half of the second line and half of the fourth line are printed after being fed by one line from the state shown in FIG. 9A. FIG. 9C shows the state in which the full of the third line and half of the fifth line are printed after further being fed by one line from the state shown in FIG. 9B. FIG. 9D shows the state in which the full of the fourth line and half of the sixth line are printed after further being fed by one line from the state shown in FIG. 9C.

Thus, the head drive unit 50 generates drive control data so that, at overlapped parts, two head chips 25 alternately undertake dot forming position along the arrangement direction of the nozzles, and that the alternate undertaking operation is repeated along the feed direction of a print paper.

So, when printing an image of large area using single color, the line color printer 11 drives the head 21 so that, at overlapped parts, dots are formed at blank parts formed by adjacent head chips. Thus, even though property between adjacent head chips are different, overlapped parts can make steep difference of printed image due to the property difference imperceptible, which can prevent deterioration of printed image.

In the line color printer 11, as has been described above, the distance $L_s$ between nozzles of adjacent head chips of the same color is set to be even number pitches, while the distance $L_d$ between nozzles of head chips of different color is set to be even number pitches, and timing of printing dots at overlapped parts where dots to be formed overlap are set to be opposite phases. Thus, as shown in FIG. 10A to FIG. 10E, dots are formed in the hound's tooth manner at overlapped parts on a print paper where dots formed by adjacent head chips of the same color overlap. When dots are formed over three lines or more, dots are formed at blank parts of the hound's tooth pattern, and dots of mixed color are concurrently formed at overlapped parts and non-overlapped parts.

As shown in FIG. 10A to FIG. 10E, the distance $L_s$ between nozzles of adjacent head chips of the same color is set to be two lines, while the distance $L_d$ between nozzles of head chips of different color is set to be four lines, and an image is printed with the print paper 14 fed by one line for respective print processing.

Figures 10A, 10B, 10C:
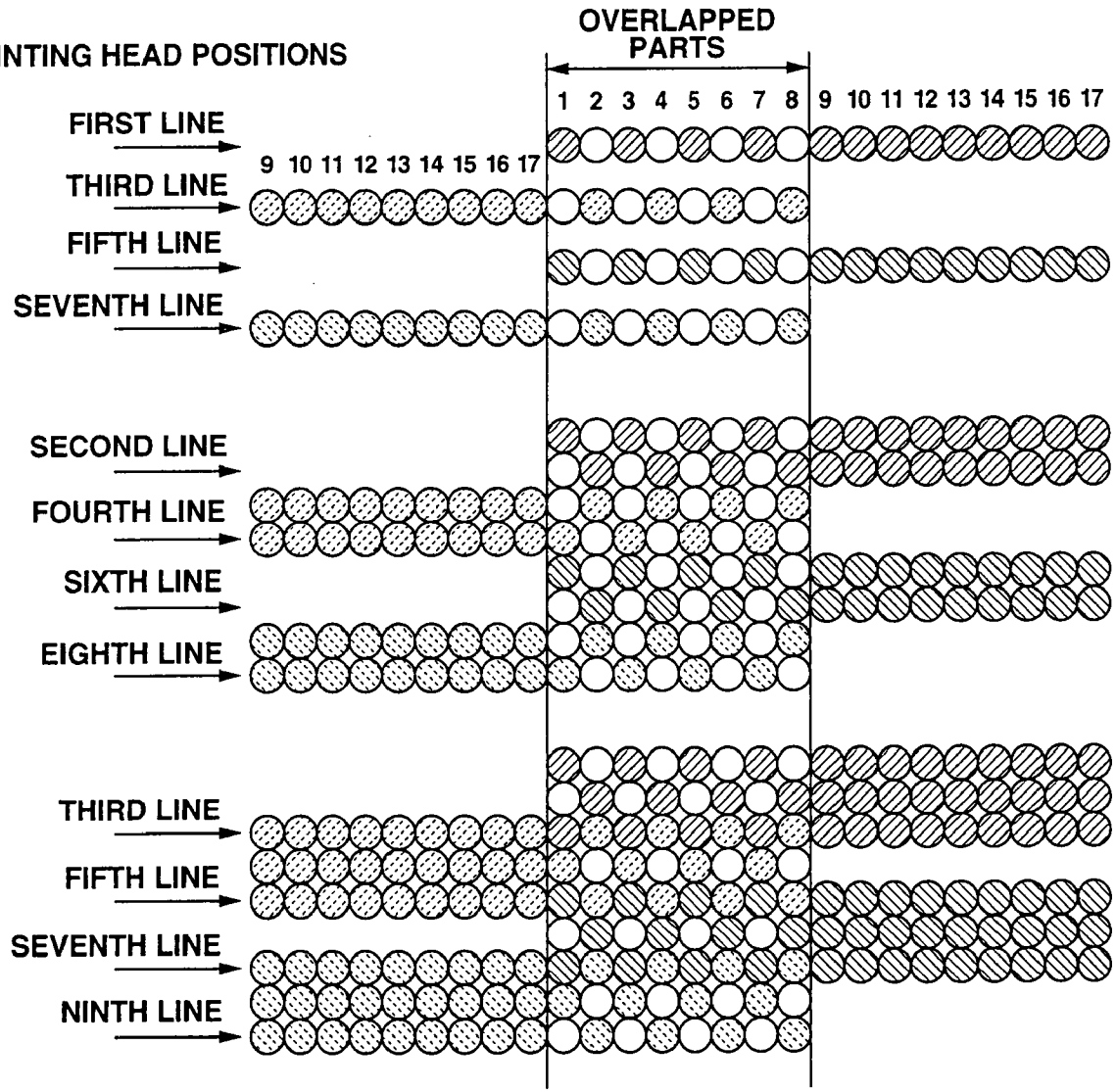
FIG. 10A to FIG. 10E show plan views indicating the printed dot state formed by head chips of different color of the line color printer.
Figures 10D, 10E:
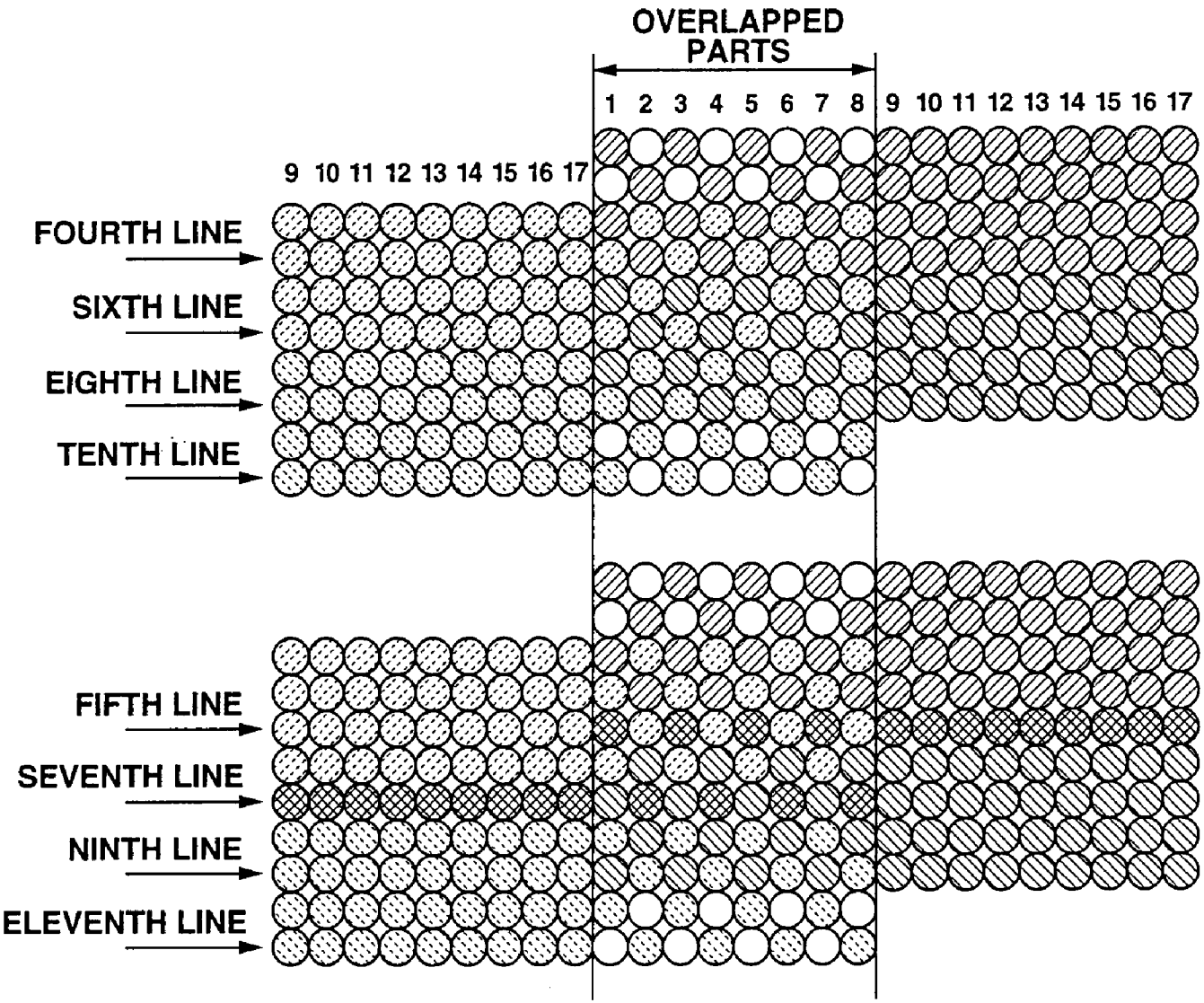

That is, FIG. 10A shows the state in which half of the first line and half of the third line are printed in cyan, in which state only half cyan data is printed, while half of the fifth line and half of the seventh line are printed in magenta, in which state only half magenta data is printed. FIG. 10B shows the state in which half of the second line and half of the fourth line are printed in cyan, while half of the sixth line and half of the eighth line are printed in magenta, after being fed by one line from the state shown in FIG. 10A. FIG. 10C shows the state in which the full of the third line is printed in cyan, that is the full of the third line is printed by feeding the print paper 14 by two lines from the third line print processing shown in FIG. 10A, while blank parts of the fifth line half of which is printed in magenta as shown in FIG. 10A is printed in cyan, while the full of the seventh line is printed in magenta, while half of the ninth line is printed in magenta, after further being fed by one line from the state shown in FIG. 10B. FIG. 10D shows the state in which the full of the fourth line is printed in cyan, while blank parts of the sixth line half of which is printed in magenta as shown in FIG. 10C is printed in cyan, while the full of the eighth line is printed in magenta, while half of the tenth line is printed in magenta, after further being fed by one line from the state shown in FIG. 10C. FIG. 10E shows the state in which half of the fifth line and half of the seventh line which are already printed in magenta are further printed in cyan to form dots of mixed color concurrently at overlapped parts and non-overlapped parts, while half of the eleventh line is printed in magenta, after further being fed by one line from the state shown in FIG. 10D.

Thus, in the line color printer 11, overlapped parts can be printed in the hound's tooth manner when driving line heads employing tiling which has overlapped parts formed therein under time division drive. And, dots of mixed color, which are generated by superposing different colors, are concurrently formed at overlapped parts and non-overlapped parts.

Thus, since different colors are superposed with their degree of dryness being equivalent to each other, the problem that coloring of superposed colors at overlapped parts becomes different from that at non-overlapped parts due to difference of degree of dryness is not raised.

As in the above, according to the present invention, overlapped parts can be printed in the hound's tooth manner in driving line heads employing tiling which has overlapped parts formed therein under time division drive.

Furthermore, according to the present invention, since overlapped parts can be printed in the hound's tooth manner when driving line heads employing tiling which has overlapped parts formed therein under time division drive, printing processing of superposing different colors can be concurrently initiated at overlapped parts and non-overlapped parts. Thus, since different colors are superposed with their degree of dryness being equivalent to each other, the problem that coloring of superposed colors at overlapped parts becomes different from that at non-overlapped parts due to difference of degree of dryness is not raised, which can perform printing processing of high quality.

In the present embodiment, heater elements are used as energy generating elements for discharging liquid ink. That is, in the present embodiment, a thermal ink jet printer is employed to explain the present invention. On the other hand, energy generating elements for discharging liquid ink are not restricted to the heater elements. For example, energy generating elements of piezoelectricity type may be used.

Furthermore, the present invention can be applied to various apparatuses for discharging liquid. For example, the present invention can be applied to an apparatus for discharging DNA-containing liquid for detecting organic samples, etc.

The invention claimed is:

1. An apparatus for discharging liquid which is provided with a head having liquid discharge parts for discharging droplets from nozzles, wherein, the head has a plurality of head chips staggeringly arranged thereon, the plurality of head chips having a plurality of the liquid discharge parts collaterally arranged therein, the plurality of head chips are so arranged in the staggering manner as to overlap at a plurality of said liquid discharge parts of adjacent head chips when viewed from the feed direction of a recording medium, so that mixed dots by said adjacent head chips are formed at said overlapped liquid discharge parts, the adjacent head chips alternately undertaking a dot forming operation at said overlapped parts along an arrangement direction of the nozzles, and that the alternate undertaking operation is repeated along the feed direction of the recording medium, and the distance between nozzles of staggeringly arranged adjacent head chips is set to be even number multiple of one pitch which corresponds to a feed length for one line of the recording medium.

2. The apparatus of claim 1, wherein the nozzles are all formed on a single orifice plate.

3. An apparatus for discharging liquid which is provided with a head having liquid discharge parts for discharging droplets from nozzles, wherein, the head has a plurality of head chips staggeringly arranged thereon for each color of droplets, the plurality of head chips having a plurality of the liquid discharge parts collaterally arranged therein, the plurality of head chips are so arranged in the staggering manner as to overlap at a plurality of said liquid discharge parts of adjacent head chips when viewed from the feed direction of a recording medium, so that mixed dots by said adjacent head chips are formed at said overlapped liquid discharge parts, the adjacent head chips alternately undertaking a dot forming operation at said overlapped parts along an arrangement direction of the nozzles, and that the alternate undertaking operation is repeated along the feed direction of the recording medium, and the distance between nozzles of staggeringly arranged adjacent head chips which form dots of the same color is set to be even number multiple of one pitch which corresponds to a feed length for one line of the recording medium as well as the distance between nozzles of head chips which form dots of different color is set to be even number multiple of one pitch which corresponds to a feed length for one line of the recording medium.

4. A method for discharging liquid which discharges droplets from nozzles, wherein, a plurality of head chips are staggeringly arranged, the plurality of head chips having a plurality of liquid discharge parts for discharging droplets from nozzles collaterally arranged therein, the plurality of head chips are so arranged in the staggering manner as to overlap at a plurality of said liquid discharge parts of adjacent head chips when viewed from the feed direction of a recording medium, so that mixed dots by said adjacent head chips are formed at said overlapped liquid discharge parts, the adjacent head chips alternately undertaking a dot forming operation at said overlapped parts along an arrangement direction of the nozzles, and that the alternate undertaking operation is repeated along the feed direction of the recording medium, and droplets are discharged from the nozzles, the distance between nozzles of staggeringly arranged adjacent head chips being set to be even number multiple of one pitch which corresponds to a feed length for one line of the recording medium.

5. A method for discharging liquid which discharges droplets from nozzles, wherein a plurality of head chips are staggeringly arranged for each color of droplets, the plurality of head chips having a plurality of liquid discharge parts for discharging droplets from nozzles collaterally arranged therein, the plurality of head chips are so arranged in the staggering manner as to overlap at a plurality of said liquid discharge parts of adjacent head chips when viewed from the feed direction of a recording medium, so that mixed dots by said adjacent head chips are formed at said overlapped liquid discharge parts, the adjacent head chips alternately undertaking a dot forming operation at said overlapped parts along an arrangement direction of the nozzles, and that the alternate undertaking operation is repeated along the feed direction of the recording medium, and droplets are discharged from the nozzles, the distance between nozzles of staggeringly arranged adjacent head chips which form dots of the same color being set to be even number multiple of one pitch which corresponds to a feed length for one line of the recording medium as well as the distance between nozzles of head chips which form dots of different color being set to be even number multiple of one pitch which corresponds to a feed length for one line of the recording medium.

6. An apparatus for discharging liquid which is provided with a nozzle forming member having nozzles formed thereon and head chips having a plurality of liquid discharge parts collaterally arranged therein, the plural liquid discharge parts discharging droplets from the nozzles, wherein, the nozzle forming member has nozzle strings composed of a plurality of nozzles corresponding to the plural liquid discharge parts, and a plurality of the nozzle strings are so arranged in a staggering manner as to overlap at parts of adjacent nozzle strings when viewed from the feed direction of a recording medium, a plurality of the head chips are so arranged in a staggering manner as to correspond to the staggeringly arranged plural nozzle strings, the plural nozzle strings formed on the nozzle forming member have the distance between staggeringly arranged adjacent nozzle strings set to be even number multiple of one pitch which corresponds to a feed length for one line of the recording medium, and the adjacent nozzle strings alternately undertaking a dot forming operation at said overlapped parts along an arrangement direction of the nozzles, and that the alternate undertaking operation is repeated along the feed direction of the recording medium.

7. An apparatus for discharging liquid which is provided with a nozzle forming member having nozzles formed thereon and head chips having a plurality of liquid discharge parts collaterally arranged therein, the plural liquid discharge parts discharging droplets from the nozzles, wherein, the nozzle forming member has nozzle strings composed of a plurality of nozzles corresponding to the plural liquid discharge parts, and a plurality of the nozzle strings are so arranged in a staggering manner as to overlap at parts of adjacent nozzle strings for each color of droplets when viewed from the feed direction of a recording medium, a plurality of the head chips are so arranged in a staggering manner as to correspond to the staggeringly arranged plural nozzle strings for each color of droplets, and the plural nozzle strings formed on the nozzle forming member have the distance between staggeringly arranged adjacent nozzle strings which form dots of the same color set to be even number multiple of one pitch which corresponds to a feed length for one line of the recording medium as well as have the distance between nozzle strings which form dots of different color set to be even number multiple of one pitch which corresponds to a feed length for one line of the recording medium, and the adjacent nozzle strings alternately undertaking a dot forming operation at said overlapped parts along an arrangement direction of the nozzles, and that the alternate undertaking operation is repeated along the feed direction of the recording medium.

8. A method for discharging liquid which discharges droplets from nozzles, wherein, nozzle strings composed of a plurality of nozzles are arranged, and a plurality of the nozzle strings are so arranged in a staggering manner as to overlap at parts of adjacent nozzle strings when viewed from the feed direction of a recording medium, droplets are discharged from the nozzles of the plural nozzle strings, the distance between staggeringly arranged adjacent nozzle strings being set to be even number multiple of one pitch which corresponds to a feed length for one line of the recording medium, and the adjacent nozzle strings alternately undertaking a dot forming operation at said overlapped parts along an arrangement direction of the nozzles, and that the alternate undertaking operation is repeated along the feed direction of the recording medium.

9. A method for discharging liquid which discharges droplets from nozzles, wherein nozzle strings composed of a plurality of nozzles are arranged, and a plurality of the nozzle strings are so arranged in a staggering manner as to overlap at parts of adjacent nozzle strings for each color of droplets when viewed from the feed direction of a recording medium, droplets are discharged from the nozzles of the plural nozzle strings, the distance between staggeringly arranged adjacent nozzle strings which form dots of the same color being set to be even number multiple of one pitch which corresponds to a feed length for one line of the recording medium as well as the distance between nozzle strings which form dots of different color being set to be even number multiple of one pitch which corresponds to a feed length for one line of the recording medium, and the adjacent nozzle strings alternately undertaking a dot forming operation at said overlapped parts along an arrangement direction of the nozzles, and that the alternate undertaking operation is repeated along the feed direction of the recording medium.

* * * * *